United States Patent [19]

Harrington et al.

[11] Patent Number: 4,667,861

[45] Date of Patent: May 26, 1987

[54] DEVICE FOR QUICK INSERTION OF FOOT IN SHOE

[75] Inventors: Richard H. Harrington; James C. Barnes, both of Ann Arbor, Mich.

[73] Assignee: Measuretek, Inc., Saline, Mich.

[21] Appl. No.: 918,114

[22] Filed: Oct. 14, 1986

[51] Int. Cl.[4] ..... A47J 51/02

[52] U.S. Cl. ..... 223/113; D2/642

[58] Field of Search ..... 233/113-119; D2/642

[56] References Cited

U.S. PATENT DOCUMENTS 3,012,702 12/1961 Van der Vliet ..... 223/113

3,623,640 11/1971 Zalejsiki ..... 223/114

FOREIGN PATENT DOCUMENTS 892939 5/1944 France ..... 223/115

*Primary Examiner*—Werner H. Schroeder

*Assistant Examiner*—Andrew M. Falik

*Attorney, Agent, or Firm*—James M. Deimen

[57] ABSTRACT

A foot insertion device to enable an athlete to very quickly don biking or running shoes while participating in a multievent sport such as swimming, biking and running triathons. The device comprises a plurality of shoe heel retaining sockets with compressible foam pad supports under the shoes. A "foot funnel" of flexible material guides the athlete's foot into a shoe. Each shoe is held open by the foot funnel and by hook and loop straps that hold the tongue in an open retracted position. The back of the shoe heel is held in position in the device by hook and loop fasteners which detach in a controlled manner. The foam pad compresses in a controlled manner also, the combination operating together to assure that the athlete's foot is completely in the shoe before the athlete moves the shoe out of the device.

19 Claims, 5 Drawing Figures

DEVICE FOR QUICK INSERTION OF FOOT IN SHOE

BACKGROUND OF THE INVENTION

The field of the invention pertains to athletic events wherein athletic shoes must be quickly donned or replaced such as triathlon events. Speed in donning or replacing shoes affects the overall performance of the triathlete. In particular, the triathlete must quickly don the biking shoes between the swimming and biking events and running shoes between the biking and running events. The timer's clock does not stop between events and the triathlete in most races returns to the same shoe changing transition area for both donning the biking shoes and the running shoes.

Donning the biking shoes normally takes 15 to 30 seconds with wet hands and wet feet. The change from biking shoes to running shoes likewise requires about 15 to 30 seconds. The athlete is understandably concentrating on the next event rather than the shoes. The transition area is typically crowded and confused as the athletes attempt to change as quickly as possible. Loose shoes are sometimes kicked or misplaced and must be hunted and found by the triathlete.

The field of the invention also pertains to devices for enabling those of limited physical capability to don shoes independently of assistance from other persons although speed is not of great importance in this instance. Other instances that may require speed and ease of shoe change are clothes models during a show, actors during a live performance, firemen, military and persons in a hurry to dress.

SUMMARY OF THE INVENTION

The new insertion device holds the triathlete's shoes wide open and in place to enable the triathlete to merely step into the shoes and kick out of the device with the shoes on. Each shoe is retained in a heel socket and resting on a compressible pad. A "foot funnel" retains the heel and sides of the shoe open. Hook and loop fasteners retain the shoe heel in the heel socket of the device. A pair of hook and loop fastener straps retract the tongue of the shoe back to fully open the tongue and sides of the shoe.

With insertion of the foot into the shoe, the hook and loop fasteners in the heel socket initially prevent downward motion of the shoe and compression of the pad. The initial support by the hook and loop fasteners in the heel socket allows the triathlete's foot to be completely inserted in the shoes before weight is applied to the heel. With the sudden firm application of the triathlete's weight to the heel, the hook and loop fasteners in the heel socket release, the foam pad compresses and the shoe descends thereby being substantially released from the "foot funnel." The athlete can thereupon kick or step forward and out of the device, the foot funnel flexing to release the sides of the shoe and the hook and loop fastener straps releasing the shoe tongue.

With the use of elastic shoe laces, the shoe is firmly on the foot and no further effort to tie the shoe laces is required. Only a few seconds are required to attach both shoes and the triathlete is again in the race.

In the preferred embodiment the insertion device comprises a vacuum formed plastic base of a high impact material such as ABS with low density polyethylene sheet plastic foot funnels. Four heel sockets are located in pairs back to back, the pair on one side for biking shoes and the other side for running shoes. The insertion device, however, is not limited to the two pair configuration but rather for other purposes may comprise a different number of heel sockets equipped with foam pads and straps. Single pair insertion devices for other athletic events such as point to point triathlons and most other purposes would be useful.

DESCRIPTION OF THE PREFERRED EMBODIMENT

Figure 1:
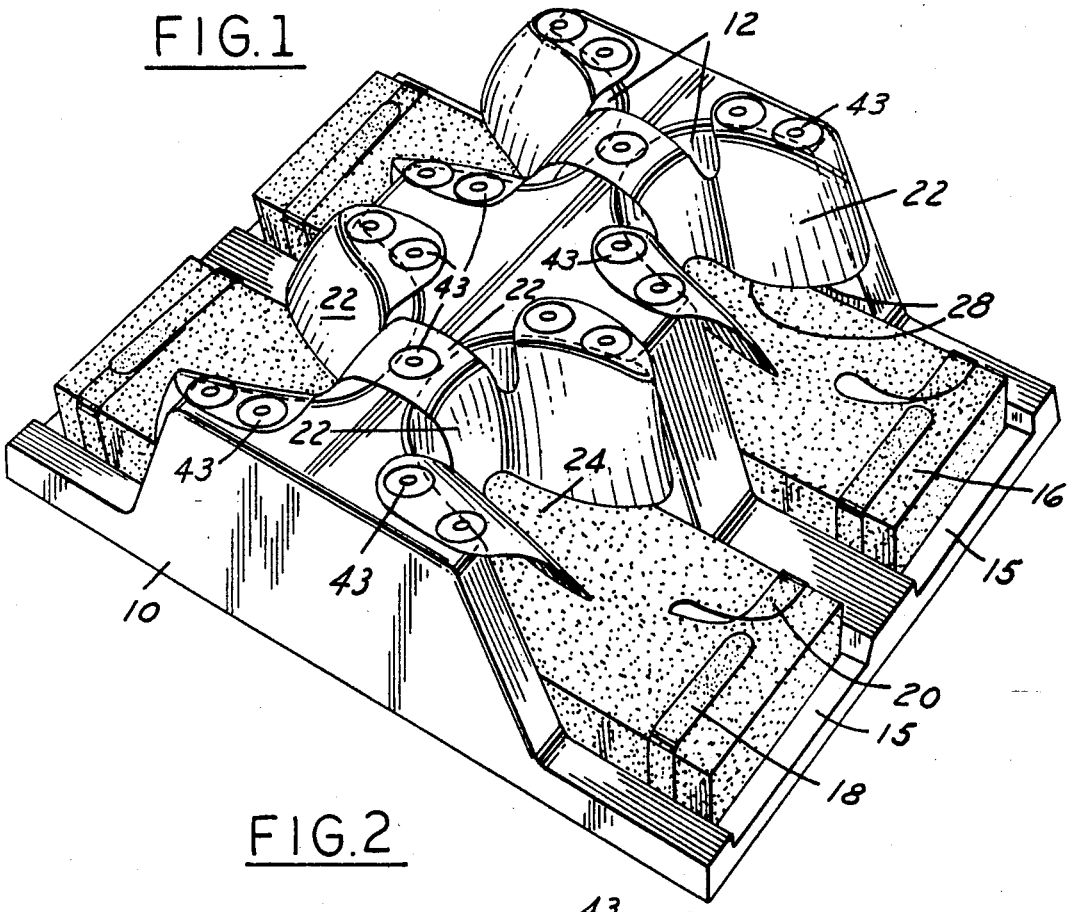
FIG. 1 illustrates in perspective the empty insertion device.
Figure 2:
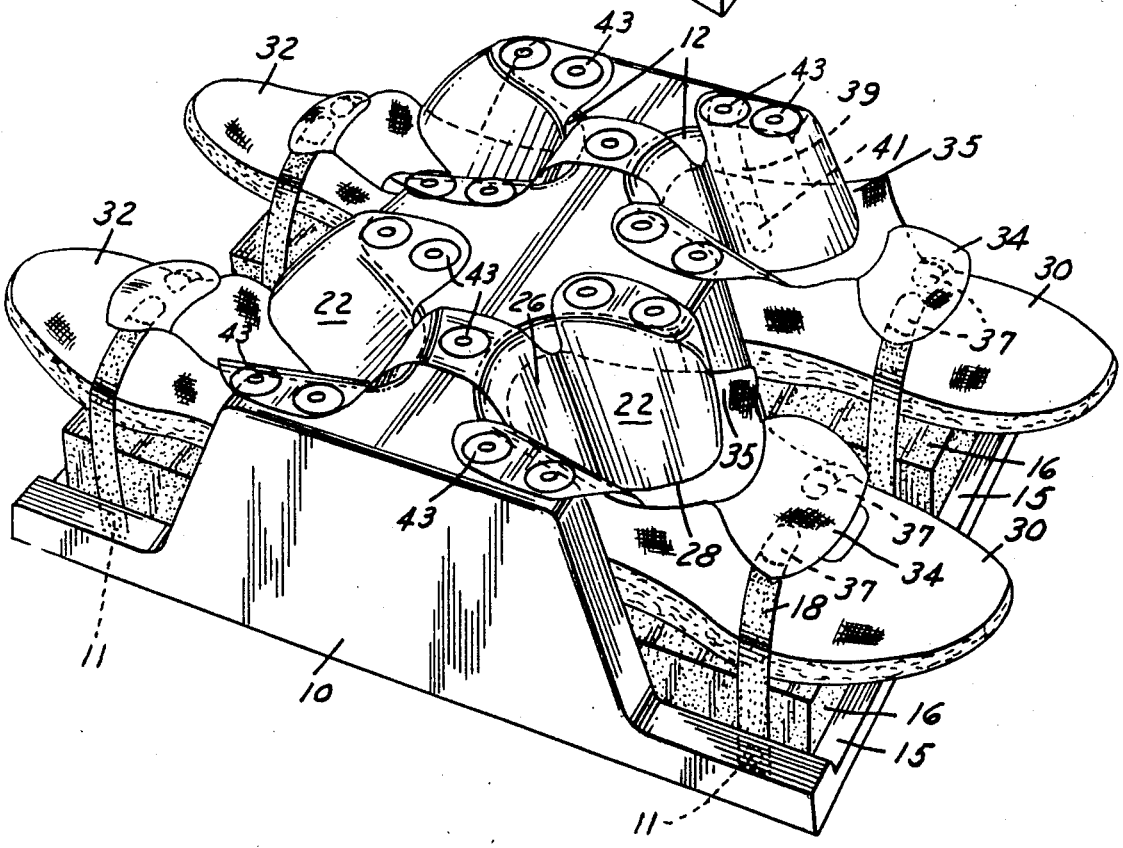
FIG. 2 illustrates in perspective the insertion device with open shoes in place.
Figure 4:
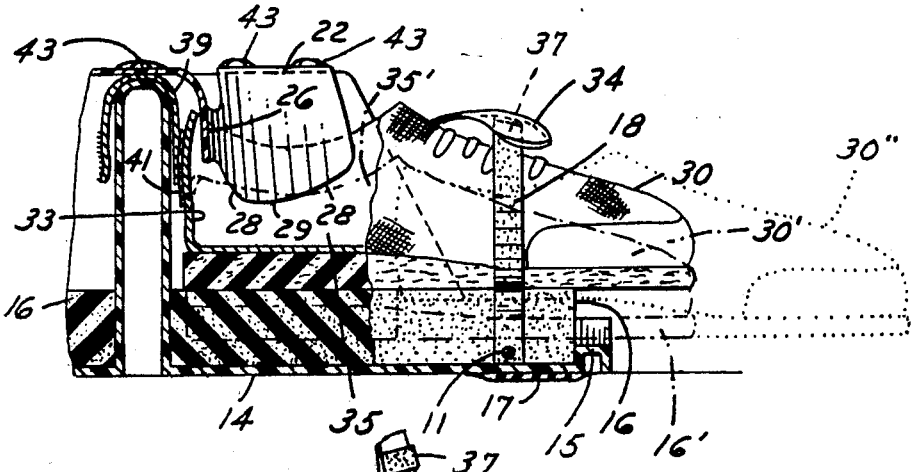
FIG. 4 is a partial cutaway vertical section of a shoe in the insertion device.

Illustrated in FIGS. 1 and 4 is the insertion device comprising a base 10 of molded rigid plastic such as high impact ABS so shaped as to form four heel sockets 12. The base 10 is formed with depressions 14 behind a lip 15 and leading into each heel socket 12. Attached beneath each depression is a rubber foot pad 17 to prevent movement of the device on a floor. Affixed within each depression 14 and leading in to the respective heel sockets 12 is a foam pad 16 to support a shoe. A pair of hook and loop fastener straps 18 and 20, such as those sold under the Velcro brand trademark, are affixed to the base 10 by rivets 11 located on the side wall of the depression 14 on both sides of the base and are used to retract the tongue 34 of a shoe as shown in FIG. 2.

Affixed to the base 10 above the back and sides of the heel socket 12 is a "foot funnel" 22 formed of thin flexible sheet plastic such as polyethylene. For back to back heel sockets 12 as shown in FIGS. 1 and 2, two foot funnels 22 may be formed from one piece of sheet plastic. The foot funnel is spaced from the sides and back of the heel socket 12 an amount sufficient to permit the insertion of the back 33 and sides 35 of the shoe behind the foot funnel 22 as best shown in FIGS. 1, 2, and 4. The foot funnel 22 is formed with an open bottom or broad slot 24 having a rounded back 26 and double tapered edges 28. The tapered edges 28 assist in insertng the shoe back 33 behind the foot funnel 22 and the rounded back 26 guides the athlete's heel into the shoe heel before the shoe is pulled from the insertion device. The double tapered edges 28 extend downwardy toward a maximum depth at 29 and then upwardly toward the rounded back 26 on each side of the foot funnel 22. The foot funnel 22 acts also to retain the shoe in the heel socket 12, however, additional means are provided as described below.

Figure 3:
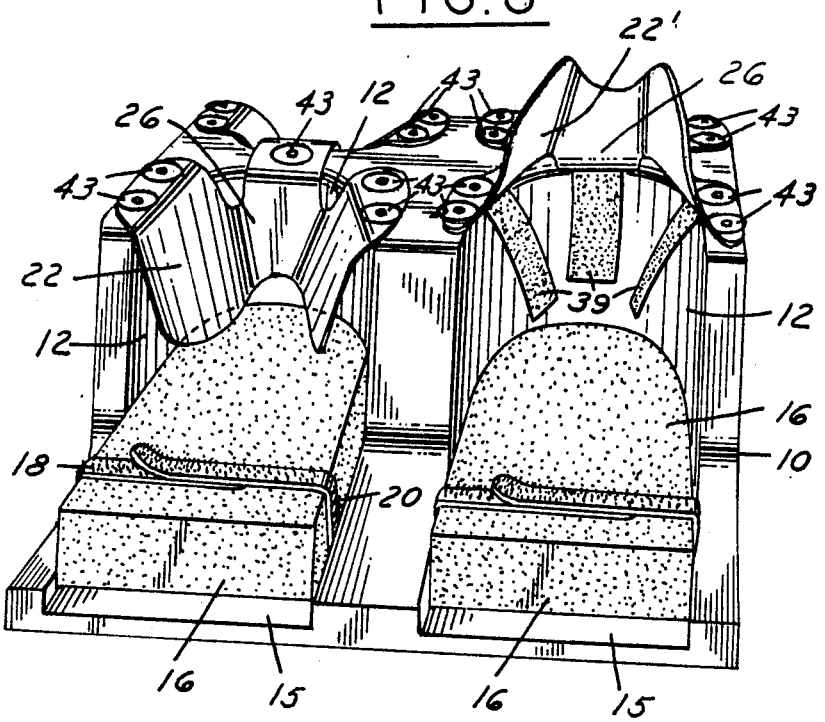
FIG. 3 illustrates in perspective the insertion device with one foot funnel fully open.
Figure 5:
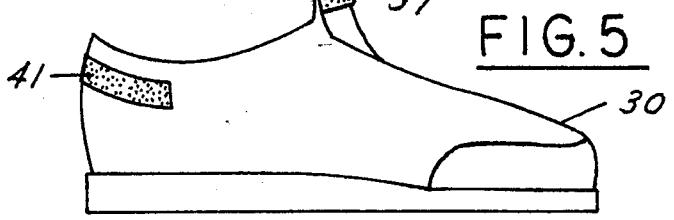
FIG. 5 is a schematic side view of a shoe.

FIG. 3 illustrates two of the heel sockets 12, the left with the foot funnel 22 in normal position and the right with the foot funnel snapped up 22' to show the additional heel attachment means. The heel attachment means comprise three Velcro brand hook and loop strip fasteners 39 attachable to complementary fasteners 41 stitched to the outside of the back 33 and sides 35 of a shoe as best shown in FIGS. 2, 4 and 5. The form and material of the foot funnel provides a bistable configuration in the down 22 or up 22' position. Thus, a shoe can be easily inserted and attached to the fasteners 39 and then the foot funnel snapped down to spread the sides 35 and back 33 of the shoe. The three strips 39 are attached with the fasteners 43 such as rivets or screws joining the foot funnel to the base 10.

The strips 39 resist downward movement of the shoe until the athlete's foot is fully in the shoe and weight applied to the athlete's heel. The athlete's weight causes the strips 39 to detach from the complementary fasteners 41. About thirty pounds of force are required to break the fasteners 39 and 41 loose. Thereupon, the athlete's weight causes the shoe 30 to squeeze the foam pad 16 downward as shown in dot-dash outline in FIG. 4 at 30' and 16'. In the lower dotted outline position the back of the shoe 30' can clear the back 26 of the foot funnel 22 and the shoe sides at 35' can pass under the low point 29 of the foot funnel 22 with minimum upward movement of the foot funnel.

The triathlete kicks out with the shoe substantially straight out in front of the socket 12 with only slight upward motion. In actual practice the substantially forward and slightly upward movement of the shoe 30 with the athlete's foot as shown in dotted outline in FIG. 4 at 30" and 35" causes the shoe side 35 toward the curvature of the shoe back 33 to move the flexible foot funnel 22 upwardly a sufficient amount to clear the shoe. The foot funnel 22, however, usually does not move to the other topmost bistable position 22' but rather snaps back down into the heel socket 12.

In FIG. 2 the shoes illustrated comprise a pair of runnng shoes 30 and a pair of biking shoes 32. The hook and loop straps 18 and 20 attach to complementary fasteners 37 sewn to the shoe tongues 34 thus holding the tongues back or retracted. The shoes are thereby held open as shown by the foot funnel 22 and the straps 18 and 20 in proper position for the quick insertion of the athlete's foot. The athlete need only step instantly into the open shoe.

Upon insertion of the athlete's foot into the open shoe and with the weight of the athlete applied to the shoe to release the strip fasteners 39, the foam pad 16 compresses at a controlled rate partially releasing the shoe back 33 and sides 35 from the foot funnel 22. With the first forward movement of the foot to begin the first step, the shoe snaps out of the foot funnel 22 and the straps 18 and 20 release the tongue 34. The foam pad 16 is selected for shock absorbing capability and controlled compression, thereby providing sufficient resistance to compression as the foot enters the shoe to also assure the foot fully enters before the tongue 34 is released. This controlled compression is particularly important with wet feet. The foam pad 16 may be constructed of open cell polyester foam approximately two inches thick in relaxed state.

The shoe laces may also be equipped with hook and loop fasteners complementary to the hook and loop fasteners of the straps 18 and 20 and held back under the tongue 34. As shown in FIG. 4 in dotted outline 30" the shoe completely releases from the insertion device with forward motion. By retaining the shoe laces to the straps 18 and 20, the laces are tightened about the foot in the instant before release from the straps. Alternatively, elastic or stretch shoe laces may be used which snap into position as the tongue 34 is released. The stretch laces allow the triathlete to start the biking phase or running phase without taking the time to tie the laces.

We claim:

1. A device to assist the insertion of a human foot into a shoe comprising a base, at least one heel socket formed in the base, resilient compressible shoe support means on the base and extending into the heel socket, means to funnel a foot into an open shoe, said funnel means extending from the base into the heel socket over the resilient compressible shoe support means and spaced therefrom, and means to retain a shoe in the heel socket.

2. The device of claim 1 wherein the funnel means comprises a flexible plastic sheet having two opposed sides joined by an integral curved back, said sides and back extending downwardly into the heel socket so as to fit inside and retain open the back portion of a shoe.

3. The device of claim 2 wherein the means to retain a shoe in the heel socket comprises the integral curved back of the funnel means.

4. The device of claim 1 wherein he means to retain a shoe in the heel socket comprises fastener means in the heel socket engageable with complementary means on the back of a shoe.

5. The device of claim 1 wherein said resilient shoe support means comprises a foam pad of sufficient compressive strength to more than support an empty shoe with negligable compression.

6. The device of claim 1 including means to retain open the tongue of a shoe inserted in the heel socket.

7. The devide of claim 6 wherein the means to retain open a shoe tongue comprise a pair of hook and loop fastener straps.

8. A device to assist the insertion of a human foot into a shoe comprising a base, means on said base to locate a shoe including a heel and tongue, resilient compressible means on the base to support a shoe and means to retain a shoe to the base with the shoe heel and tongue held open, said retention means including means to guide a foot into a shoe and including further means to release the shoe upon full insertion of a foot into a shoe.

9. The device of claim 8 wherein the guide means hold open the back and sides of a shoe.

10. The device of claim 8 wherein the retention means include straps with fastening means thereon attachable to a shoe tongue.

11. The device of claim 8 wherein the retention means include strips attached to the base, said strips including fastening means attachable to the back of a shoe.

12. The device of claim 8 wherein said guide means flex to release a shoe upon insertion of a foot and forward motion of the foot.

13. The device of claim 12 wherein said flexible guide means is movable between a first and second stable position.

14. The device of claim 8 wherein the retention means include strips attached to the base, said strips including hook and loop fasteners attachable to complementary hook and loop fasteners on the back of a shoe, said complementary fasteners detachable under shear with force less than the weight of an athlete.

15. The device of claim 8 wherein the resilient compressible means in the relaxed state will support an empty shoe but will compress with the application of the weight of an athlete.

16. A device to assist the insertion of a human foot into a shoe comprising a base, at least one heel socket formed in the base, resilient compressible shoe support means on the base and extending into the heel socket, flexible means to funnel a foot into an open shoe, said funnel means extending from the base into the heel socket over the resilient compressible shoe support means and spaced therefrom, and means to retain a shoe in the heel socket and resting on the resilient compressible shoe support means, said retention means capable of releasing the shoe upon application of the weight of an athlete to the shoe.

17. The device of claim 16 wherein the retention means include means attachable to a shoe tongue to retain open the tongue until an athlete steps into the shoe and moves the shoe forward out of the device.

18. The device of claim 16 wherein a plurality of the devices are located on a single base.

19. The device of claim 18 wherein two pair of the devices are located back to back on a single base.

* * * * *